US005507918A

United States Patent [19]

Polifke et al.

[11] Patent Number: 5,507,918

[45] Date of Patent: Apr. 16, 1996

[54] TWIN-WIRE FORMER

[75] Inventors: Hubert Polifke; Franz Pisinger; Udo Grossmann, all of Heidenheim, Germany; Sven-Ake Sahlin, Skoghall, Sweden; Hans-Peter Sollinger, Heidenheim, Germany; Dieter Egelhof, Heidenheim, Germany; Christian Schiel, Heidenheim, Germany; Thomas Züfle, Heidenheim, Germany

[73] Assignee: J.M. Voith GmbH, Germany

[21] Appl. No.: 107,674

[22] PCT Filed: Dec. 16, 1992

[86] PCT No.: PCT/DE92/01053

§ 371 Date: Feb. 2, 1994

§ 102(e) Date: Feb. 2, 1994

[87] PCT Pub. No.: WO93/12292

PCT Pub. Date: Jun. 24, 1993

[30] Foreign Application Priority Data

| | | | |
|---|---|---|---|
| Dec. 17, 1991 | [DE] | Germany | 41 41 607.4 |
| Apr. 15, 1992 | [DE] | Germany | 42 12 609.6 |
| Oct. 17, 1992 | [DE] | Germany | 42 35 102.2 |

[51] Int. Cl.[6] ..... D21F 1/00

[52] U.S. Cl. ..... 162/301; 162/300; 162/352

[58] Field of Search ..... 162/300, 301, 162/352

[56] References Cited

U.S. PATENT DOCUMENTS

| | | | |
|---|---|---|---|
| 4,523,978 | 6/1985 | Pullinen | 162/352 |
| 4,988,408 | 1/1991 | Evalahti | 162/301 |
| 5,045,153 | 9/1991 | Sollinger et al. | 162/301 |
| 5,074,964 | 12/1991 | Partanen | 162/300 |
| 5,078,835 | 1/1992 | Schiel et al. | 162/352 |
| 5,167,770 | 12/1992 | Bubik et al. | 162/301 |
| 5,320,713 | 6/1994 | Bubik et al. | 162/301 |

FOREIGN PATENT DOCUMENTS

| | | | |
|---|---|---|---|
| 0251778 | 1/1988 | European Pat. Off. . | |
| 0371786 | 6/1990 | European Pat. Off. . | |
| 0405154 | 1/1991 | European Pat. Off. . | |
| 0438685 | 7/1991 | European Pat. Off. . | |
| 3217860 | 12/1982 | Germany . | |
| 3138133 | 3/1983 | Germany . | |
| 9105797 | 8/1991 | Germany | 162/301 |
| 1346385 | 2/1974 | United Kingdom . | |
| 2174120 | 10/1986 | United Kingdom . | |
| 9102842 | 3/1991 | WIPO . | |
| 9110775 | 7/1991 | WIPO . | |
| 9114826 | 10/1991 | WIPO . | |

*Primary Examiner*—Karen M. Hastings
*Attorney, Agent, or Firm*—Ostrolenk, Faber, Gerb & Soffen

[57] ABSTRACT

The twin-wire former serves for the production of a web of paper or board. Two wire belts (endless wire loops 11 and 12) form a twin-wire zone with each other. Within the twin-wire zone, the one wire belt (12) travels over rigid ledges (28', 28) which are arranged spaced apart from each other on a water-removal box (18). Within the twin-wire zone, furthermore, the other wire belt (11) travels over several ledges (27) which lie opposite the rigid ledges (28), are supported by means of resilient elements (springs 24, pneumatic pressure cushions, or the like), and can be pressed with a selectable force against the other wire belt. Within one of the wire loops (for instance 11), bridging at least two of the ledges (27) present there, a closed wire support surface (9) is provided. A secondary headbox (10') can be arranged in front of the closed wire support surface (9).

41 Claims, 6 Drawing Sheets

Fig. 6
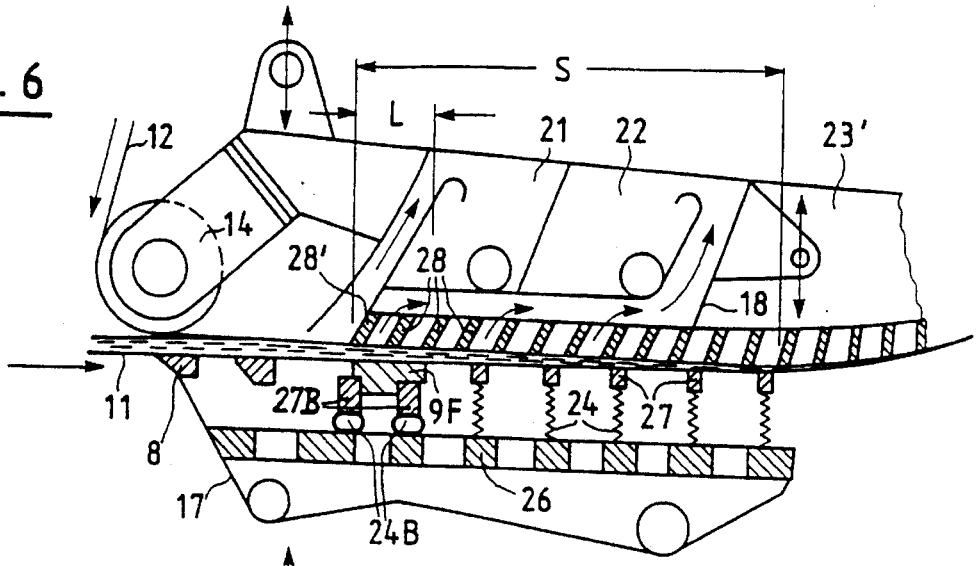
Fig. 7
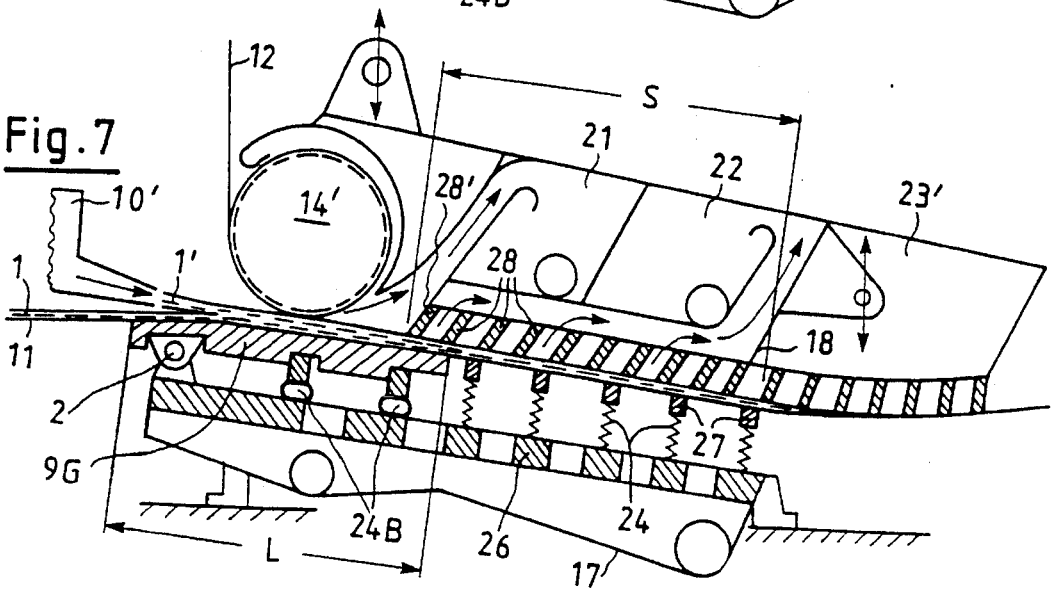
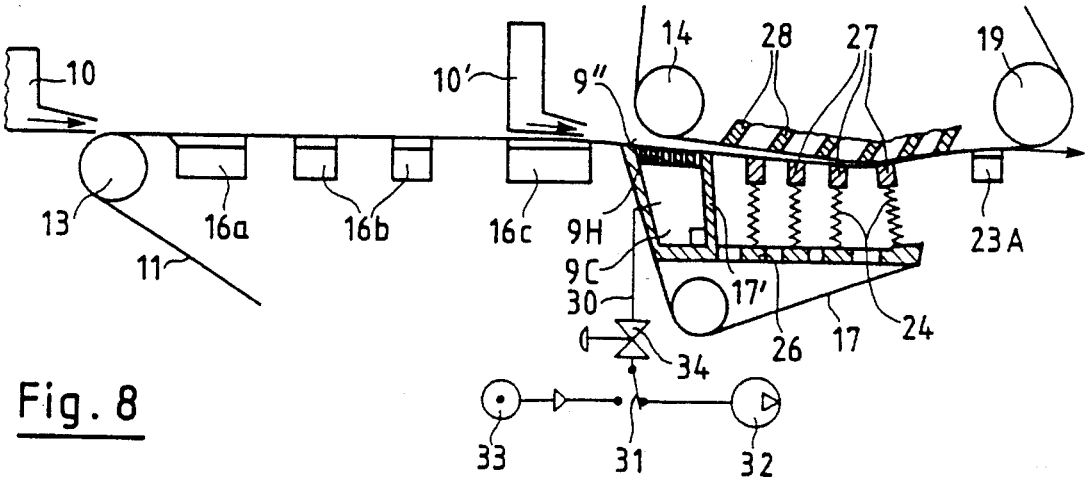
Fig. 8

TWIN-WIRE FORMER

The present invention relates to a twin-wire former for the production of a fiber web, in particular a web of paper or board, from a fiber suspension, and particularly to a twin-wire former having ledges above the forming wires of the twin-wire former for aiding in directing the water away from the wires. In such a twin-wire former, there are two paper machine wire belts or wires which together form a twin-wire zone, and the fiber suspension travels between the belts. Each of the wire belts travels over a respective plurality of ledges which are arranged on the outsides of the belts. The ledges in each plurality thereof are arranged at a distance apart from each other. One plurality of ledges above one wire are rigid ledges. The other plurality of ledges above the other wire are resiliently supported to be pressed against the other wire belt. The following publications are indicated as prior art:

1. GB 2174120 A
2. EP 0371786 A2
3. WO 91/02842
4. DE-OS 40 05 420 which is equivalent to U.S. Pat. No. 5,045,153
5. EP 0405154 A1

Documents 1 and 2 disclose different twin-wire formers in each of which the top wire travels along the (substantially flat) lower side of a dewatering box. According to EP '786 this dewatering box has rigid ledges on its bottom. Directly below said rigid ledges the bottom wire travels over ledges which can be applied against it resiliently. In several embodiments of GB '120 the ledges are close together so that water cannot discharge downward through the bottom wire in this region. The same is true of other embodiments of GB '120 in which a flexible plate is provided instead of ledges. In further embodiments of GB '120, smaller or larger spaces are present between resiliently appliable ledges, which spaces can receive smaller or larger amounts of water and discharge them laterally to the outside. This is true also of the twin-wire former in accordance with EP '786. In all of these cases, the entire flat lower surface of the dewatering box which is arranged in the top wire is covered by the resiliently appliable ledges present in the bottom wire or by the said flexible plate, with the exception of at most the narrow zones of the intermediate spaces. This has the result that the discharge of the water downward is prevented to a greater or lesser extent in the entire region of the flat bottom side of the dewatering box.

Therefore, one of the disadvantages of all of these known arrangements is that the dewatering takes place exclusively (or practically exclusively) in the upward direction in the region of the resiliently appliable ledges (or of the flexible plate). Therefore, the quality of the fiber webs produced leaves something to be desired, in particular with regard to the "formation" or "cloudiness". There is also the problem that the said intermediate spaces become clogged with the passage of time, so that the formation is not uniform over the width of the web.

Therefore, a construction was adopted in the prior art which only relatively few ledges which could be pressed resiliently against the one wire are provided. Here, large spaces which can receive large amounts of water are present between the ledges. Furthermore, openings are provided so that these amounts of water can discharge downward over the shortest possible path. Twin-wire formers of this type are described in Publications 3 and 4. In general, the following is true of the twin-wire formers in accordance with Publications 1–4: Due to the resiliently supported ledges which are arranged opposite the rigid ledges, the following can be achieved: For instance, upon an increase in the amount of suspension flowing in between the two wire belts, the resiliently supported ledges can move away somewhat. In this way, the danger (which exists when rigidly supported ledges alone are used) of a damming up occurring in the fiber suspension in front of the ledges is eliminated. Such a damming up could destroy the fiber layers formed up to that time on the two wire belts. In other words: In the known twin-wire formers in accordance with Publications 1–4, a dewatering pressure which has once been set remains constant due to the resiliently supported ledges even upon a change in the amount of suspension fed or upon a change in the dewatering behavior of the fiber suspension. An automatic adaptation of the width of the gap between the fixed and resilient ledges therefore takes places when one of the said changes occurs. The known arrangements therefore permit the production of webs having a very large range of basis weights, namely from relatively thin paper webs to relatively thick board webs.

With the twin-wire formers known from Publication 3 or 4, fiber webs of relatively good "formation" (i.e. with uniform distribution of fiber — or, in other words, with good "cloudiness") can be formed. In this connection, however, in recent days the requirements have increased considerably so that further improvements are desirable.

The object of the present invention is, therefore, to develop a twin-wire former in such a manner that the quality of the fiber web produced is further improved, particularly with respect to its formation (cloudiness).

This object is achieved by the features below. In accordance with a first aspect of the invention, a wire support surface is provided in the initial region of that part of the twin-wire zone in which the stationary and resilient ledges are opposite each other— and/or directly in front of this part of the twin-wire zone— over which support surface one of the two wire belts travels. This wire support surface is preferably completely water-impermeable; however, it may also be of limited water permeability. In any event, it is seen to it in the region of this wire support surface that the removal of water takes place "temporarily" exclusively (or almost exclusively) through the opposite wire belt ("temporarily" means only in a relatively small initial region of the said part of the twin-wire zone). The normal water removal on both sides is therefore intentionally shifted a distance further in the direction of travel of the web. By this measure, a considerable improvement in the formation is surprisingly obtained, as shown by experiments.

This favorable result can be obtained independently of the direction of travel of the wire belts through the twin-wire zone, and therefore with horizontal, inclined, or vertical direction of travel of the wire. In the case of predominantly horizontal direction of travel of the wire belts through the twin-wire zone, the resiliently supported ledges are in general associated with the bottom wire. In that case, it is advantageous to associate the said wire support surface also with the bottom wire. However, it is also possible to arrange the wire support surface within the loop of the top wire; this may be advantageous if the twin-wire former has a single-wire pre-water-removal zone. In general, by the selection of the arrangement of the wire support surface in either one or the other wire loop, the distribution of the fines and fillers within the thickness of the fiber web to be produced can be controlled.

In accordance with a second aspect of the invention, a wire support surface is provided in each of the two wire loops rather than in only one. In this case, the arrangement is effected in such a manner that the two wire support surfaces overlap each other in whole or in part. The following explanations relate to twin-wire formers having only a single wire support surface; they apply, however, by analogy also when two wire support surfaces are present opposite each other.

The following is again emphasized:

The essentially water-impermeable wire support surface provided in accordance with the invention which temporarily prevents the discharge of water is to be present only at the start of the said part of the twin-wire zone.

In other words, the invention is based on the discovery that, differing from all the previous designs, the removal of water through one of the two wires must be temporarily braked or prevented only in the initial region of the zone in which rigid and resiliently supported ledges lie opposite each other. In this way, it is possible to produce fiber webs of the highest quality (particularly with regard to the "formation") and to do so— as previously— within a very large range of basis weights, from relatively thin paper webs up to relatively thick board webs. An indispensable requirement for this is that an essential part of the formation of the web take place in that part of the twin-wire zone in which the said resiliently supported ledges cooperate with the opposite rigidly supported ledges, in which connection— as already mentioned— the substantially water-impermeable wire support surface of the invention must be provided in the initial part of this zone.

Publication 5 (EP '154) describes a twin-wire former of a different type. In that case, the twin-wire zone is formed by a curved water-removal box which lies in the loop of the bottom wire and has on its top initially a curved shoe followed by several stationarily supported ledges arranged at a distance apart along the curved path of travel of the wire. Above this water-removal box, there is present in the loop of the top wire another water-removal box which, however, contacts the upper wire only by a single ledge which is arranged behind the lower water-removal box. To be sure, the discharge of water in downward direction is temporarily interrupted by said shoe. Cooperation of this shoe with rigid and resilient ledges which lie opposite each other— as explained above— is, however, neither disclosed nor suggested in EP '154.

The part of the twin-wire zone in which rigid and resiliently supported ledges lie opposite each other and in which at least a part of the substantially water-impermeable wire support surface of the invention is located will be referred to below as the "sandwich zone". The length of the wire support surface is between 10 and 60% of the length of the "sandwich zone". The length of the wire support surface will be adapted to the operating conditions prevailing in the individual case (in particular, with respect to the speed of the machine and the basis weight of the web to be produced). The position of the wire support surface may differ; it can, for instance, lie in part in front of and in part within the "sandwich zone". As an alternative to this, it can be arranged completely within the "sandwich zone". In a preferred construction, the position of the wire support surface is variable within the above said limits.

In order to eliminate the danger of damming up occurring in the fiber suspension (as described above) in front of the wire support surface (seen in the direction of travel), it is advantageous to press the wire support surface against the bottom wire by means of resilient elements (spring, pressure cushions or the like). The pressing force can be freely selected within certain limits (as in the case of the resilient ledges), for instance by changing the spring force or the cushion pressure.

If the twin-wire former in accordance with the invention has (in known manner) a predominantly horizontally extending single-wire pre-water-removal zone, a secondary headbox can be provided shortly before the start of the twin-wire zone. By means of it, a second layer can be delivered onto the pre-dewatered first fiber layer. As a rule, the two layers have different properties, for instance different colors. In this case, an additional advantage is obtained by means of the wire support surface of the invention, which in this case supports the bottom wire; namely, the result is obtained that the second suspension layer is not directly dewatered after the feeding thereof through the first layer which has already been pre-dewatered. Rather, the second layer of suspension is dewatered initially exclusively (or almost exclusively) in upward direction. In this way, it is avoided that a component of the second suspension layer, for instance the coloring substance, penetrates rapidly into the first layer. In other words, the result is obtained that certain different properties of the layers, for instance different colors, remain unchanged up to the completion of the web of paper or board.

Further concepts of the invention are concerned with the problem of further developing a plate which forms the wire support surface. As already mentioned above, this plate is pressed from below against the bottom wire by resilient members, preferably pneumatic pressure cushions whose pressure is variable. During operation, the plate should be fastened securely on the resilient elements with respect to the direction of travel of the wire. Nevertheless, it should be capable of being easily pushed in and out transverse to the direction of travel of the wire, for instance, in order to change its position in the direction of travel of the wire or simply in order to replace it by another one. Another problem consists in developing the plate in such a manner that all regions thereof rest with relatively little application of force snugly against the bottom of the bottom wire. This will be true primarily of several zones of the plate which follow one another in the direction of travel of the wire and extend transverse to the direction of travel of the wire. Solutions of these additional problems are given herein.

BRIEF DESCRIPTION OF THE DRAWINGS

Various embodiments of the invention will be described below with reference to the drawings.

Each of FIGS. 1 to 8 shows diagrammatically one of the various embodiments, in part in side view and in part in longitudinal section.

Figure 1:
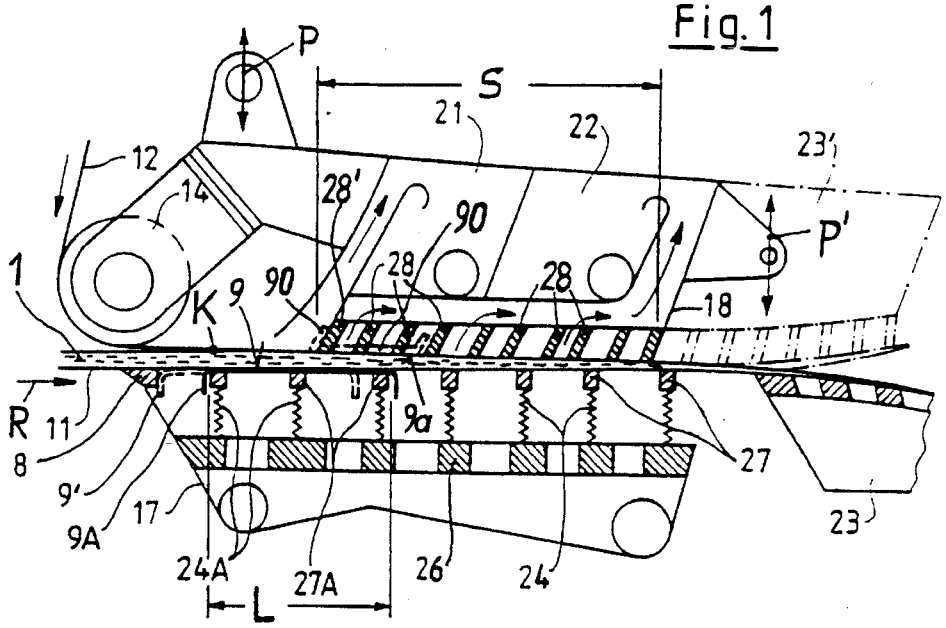
In FIG. 1, two wire belts 11 and 12 (with the fiber suspension 1 which is in part still liquid between them) travel in the direction indicated by the arrow R between a lower water-removal box 17 and an upper water-removal box 18. The lower water-removal box is provided on its front end (as seen in the direction of travel of the wire) with a rigid ledge 8 which, however, can also be omitted. It is followed at a variable distance by a closed, and therefore water-impermeable, plate 9A which forms a wire support surface 9 for the bottom wire belt 11. The plate is supported on a rigid water-permeable plate 26 via ledges 27A and compression springs 24A (the spring force of which is adjustable) or via pneumatic pressure cushions. Following plate 9A in the direction of travel of the web there are several ledges 27 (of, for instance, approximately rectangular cross section) which are pressed resiliently from below against the bottom wire 11. For this purpose they are supported, for instance via compression springs (or via pneumatic pressure cushions), on the rigid water-permeable plate 26. It is obvious that the force of the compression springs 24 (or the pressure prevailing in the pressure cushions) can be adjusted individually at each individual ledge 27. A preferred construction of the ledges 27 and of their vertical guidance is described in DE 40 19 884 which is equivalent to U.S. Pat. No. 5,078, 835. The following alternative is not shown: The ledges 27 rest on a flexible plate which is supported by a plurality of pneumatic pressure cushions. In accordance with a further alternative, the plate 9A could be provided with relatively fine vertical holes or slits which permit a "braked" discharge of water in downward direction.

The upper water-removal box 18, on which a guide roll 14 for the top wire 12 is supported, can be suspended both on its front end and on its rear end as indicated schematically by the double-ended arrows P and P', on approximately vertically displaceable support elements, not shown. Thus, the position of the guide roll 14 and of the box 18 can be adjusted, if necessary, even during operation. On the bottom of the box 18 there is a row of, for instance, at least eight ledges 28, 2' having, for instance, a parallelogram-shaped cross section, which rest against the top of the top wire 12 and are firmly attached to the box 18. Above the ledges 28, 28' a front vacuum chamber 21 and a rear vacuum chamber 22 are provided in the water-removal box 18. In front of the upper water-removal box 18, the top wire 12 travels over the said guide roll 14. It is therefore assumed in FIG. 1 that the bottom wire 11 forms a substantially horizontal single-wire pre-water-removal path between a headbox (not shown) and the place where it comes together with the top wire (see FIG. 2). The fiber suspension which has been pre-dewatered but still contains in part liquid fiber suspension is shown in exaggerated thickness in FIG. 1. It can be seen, however, that box 18 and guide roll 14 are so adjusted that the top wire comes into contact with the top of the fiber suspension between guide roll 14 and the first ledge 28', namely at the place K. The feed side edge (or "front edge") of the plate 9A is also present approximately there. Its discharge-side edge (or "rear edge") lies approximately below the third ledge 28 of the box 18. The zone in which the upper ledges 8 lie opposite the lower ledges 27 and a part of the plate A is the so-called "sandwich zone" S.

In accordance with FIG. 1, the following is provided as example: In the region of the upper water-removal box 18, the number of rigid ledges 28 is greater (preferably about twice as great) as the number of lower, resiliently supported ledges 27. On the upper water-removal box, the distances between two adjacent ledges is approximately two to four times the thickness of the ledges. In the case of the lower ledges, these distances are substantially greater. Within the length of the upper box 18, each of the lower ledges 27 lies opposite a gap between two upper ledges 28. Every two or three upper ledges 28 lie opposite a gap between two lower ledges 27. (Differing from FIG. 1, the upper and lower ledges can also be at approximately the same distances from each other; see FIGS. 2–5).

The dewatering boxes 17 and 18 are followed by, for instance, a curved suction box 23 arranged in the lower wire 20 or by a similar curved suction box 23' in the form of an extension of the box 18, arranged in the top wire 12.

Upon the operation of the twin-wire former, an intensive two-sided removal of water (downward and upward) takes place in the region where the lower and upper ledges 27, 28 are opposite each other, each of the ledges 27, 28 producing, by a slight (scarcely visible) deflection of the corresponding wire belt 11 or 12 in the still liquid part of the fiber material, a pressure pulse which effects a more uniform distribution of the fiber (for instance, breaks up flocks). This action is intensified by the fact that at the start of the twin-wire zone the removal of water in downward direction is temporarily interrupted or at least braked by the plate 9A so that here water removal takes place exclusively, or almost exclusively, in upward direction. Accordingly, the zone in which the lower ledges 27 produce the said pressure pulses in the still liquid fiber material is shifted in the direction of travel of the web. The extent of this shift can be varied in the manner that the position of the plate 9A is changed in the direction of travel of the web or opposite thereto; see, for instance, the position designated 9'. Or else a plate of a different length L is inserted. However, as a rule, at least the first upper ledge 28' should be opposite the plate 9A. The length L of the plate 9A (measured in the direction of travel of the wire) is in FIG. 1 about 50% of the length of the sandwich zone S. In general, the length L of plate 9A will be in the range of 10% to 60% of the length of the sandwich zone S.

FIG. 1 also shows diagrammatically other possible variants: As an alternative or in addition to the plate 9A which supports the bottom wire 11, a plate 90, the bottom of which (wire support surface 9*a*) contacts the top wire 12, can be provided in the loop of the top wire 12. The plate 90 is preferably arranged at the place of the first (for instance, two or three) ledges 28' and 28, for instance fastened on correspondingly shortened ledges. If the lower plate 9A is also present, the two plates 9A and 90 overlap, at least in part. The position and/or length of the plate 90 is variable in the same way as the plate 9A.

Figure 2:
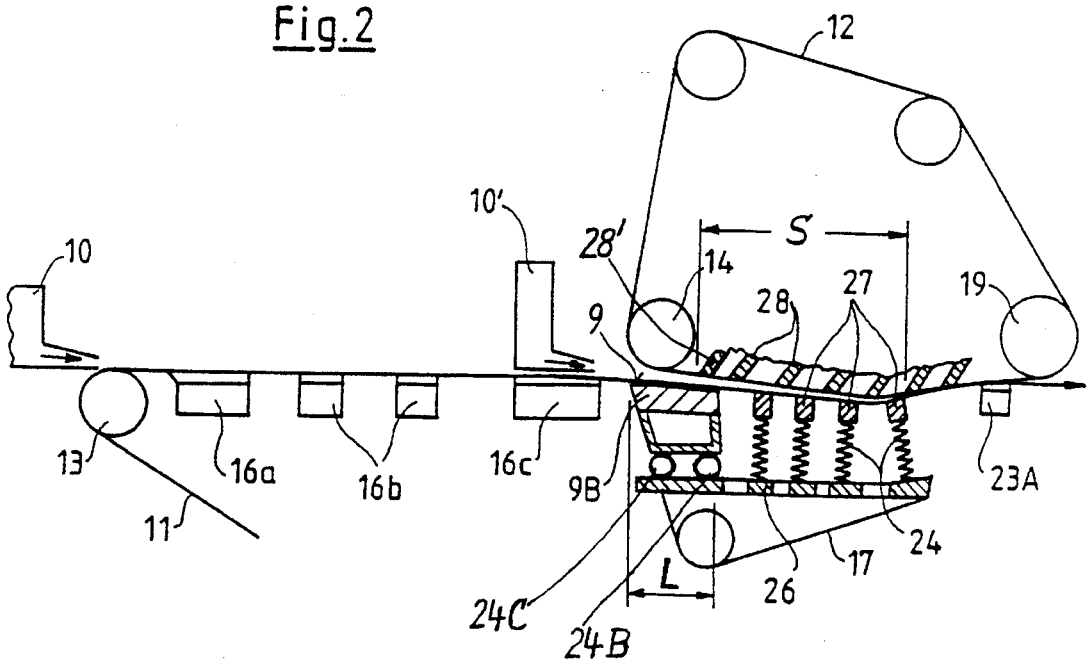

In accordance with FIG. 2, the bottom wire 11 travels toward a headbox 10 over a breast roll 13 and then over water removal elements 16*a*, 16*b* and 16*c*. The last of these water-removal elements is developed as a curved suction box 16*c*; from here the bottom wire 11 travels with a slight inclination downward over a shoe 9B and over lower ledges 27 resiliently supported on a box 17. The surface of the shoe 9B forms a water-impermeable wire support surface 9 for the bottom wire 11. The shoe 9B is supported on the box 17 by two resilient elements, for instance pneumatic pressure cushions 24C and 24B (which extend transversely through the machine). The cushion pressures can be adjusted individually. The front pressure cushion 24C could be replaced by a joint the axis of which extends transversely through the machine. Above the curved suction box 16 there is a secondary headbox 10'. Above the shoe 9B and the ledges 27 there is again a top wire 12 which travels over wire guide rolls 14 and 19 and over rigid ledges 28' and 28 of an upper water-removal box which is otherwise not shown. The front wire guide roll 14 is located at only a slight distance from the wire support surface 9. Here, the twin-wire zone begins; it ends at a separation suction box 23A. The twin-wire zone extends initially with slight inclination downward and then with slight inclination upward to the said separation suction box 23A. The rigid ledges 28 are adapted to this course of the twin-wire zone; the same is true of the resilient ledges 27 supporting the bottom wire and of the shoe 9B. Its length L (in the direction of travel of the wire) is about 40% of the length of the sandwich zone S.

The twin-wire former shown in FIG. 3 again has a substantially horizontally extending but slightly upward curved twin-wire zone. It comprises three sections, I, II and III, arranged one behind the other. The endless wire belts (bottom belt 11 and top belt 12) which are shown only in part, travel in the immediate vicinity of a headbox 10 over separate breast rolls 13 and 14, respectively, so that the two wire belts form a wedge-shaped entrance gap 15 at the start of the twin-wire zone. The jet of pulp given off from the headbox 10 comes into contact with the two wire belts 11 and 12 first of all at the place where the bottom wire 11 travels in the first section I of the twin-wire zone over a stationary curved forming shoe 16. The curved travel surface of the latter is formed of several ledges 16' (with water-removal slots present between them) and of an adjoining shoe C which forms a water-impermeable wire support surface 9. The distance between the two breast rolls 13 and 14 is variable. The forming shoe 16 can be operated with or without vacuum. It can be supported rigidly or resiliently (for instance, by means of pneumatic pressure cushions) on a machine frame, not shown (or by means of a joint on the feed-side end and by means of a pressure cushion only in the region of the shoe 9C).

In the second section II of the twin-wire zone, the two wire belts 11 and 12 (with the fiber suspension which is in part still liquid present between them) travel between a lower water-removal box 17 and an upper water-removal box 18. In the lower water-removal box 17 there are a plurality of ledges 27 (of approximately rectangular cross section) which, as in FIGS. 1 and 2, are pressed resiliently from below against the bottom wire 11.

The upper water-removal box 18, which is developed as shown in FIG. 1, has a plurality of rigid ledges 28 on its bottom side. In the region of the forming shoe 16, part of the water of the fiber suspension is discharged downward; another part penetrates— due to the tension of the top wire 12— upward through the top wire and is deflected by the frontmost ledge of the ledges 28 into the front vacuum chamber 21. The water penetrating upward between the upper ledges 28 passes into the rear vacuum chamber 22. The water penetrating through the lower wire 11 between the lower ledges 27 is discharged downward.

In the third section, III, of the twin-wire zone, both wire belts 12 and 13 travel over another curved forming shoe 23 which (as shown) is arranged preferably in the lower wire loop 11. Following that, an additional ledge 29 with vacuum chamber 30 can be provided in the loop of the top wire 12. Furthermore, flat suction boxes 31 can be provided within the loop of the bottom wire. There (as shown by dash-dot lines) the top wire 12 can be separated by means of a guide roll 19 from the bottom wire 11 and from the fiber web formed. The bottom wire and the fiber web then travel over a wire suction roll 20. The guide roll 19 can, however, also lie further towards the rear, so that the top wire is separated from the bottom wire 11 only at the wire suction roll 20.

The distance between the two wires 11 and 12 has been exaggerated in the drawing. In this way, it is intended to make it clear that the two wires 11 and 12 converge towards each other over a relatively long path within the twin-wire zone. This indicates that the process of the formation of the web commences relatively slowly on the first forming shoe 16 (in section I) and is completed only in section III. In this connection, the end of the main water-removal zone in which the two wires converge towards each other (and thus the end of the web-forming process) lie, for instance, approximately in the center of the wrapping zone of the second forming shoe 23, as shown, for example, in FIG. 3. The end of the wire convergence is indicated symbolically there by the point E; at that point the solids content of the paper web has reached a value of about 8%. This point can, however, also lie, for instance, on one of the flat suction boxes 31 or in the end region of section II.

Figure 4:
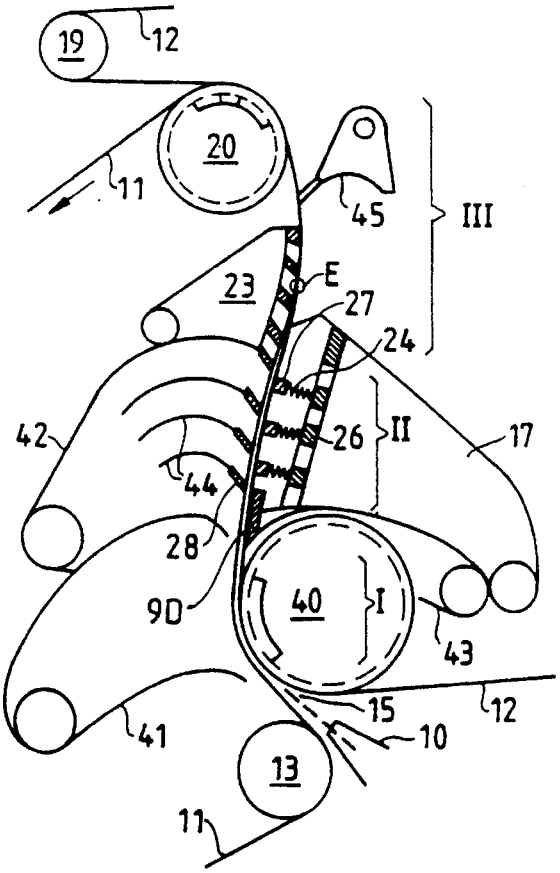
Figure 5:
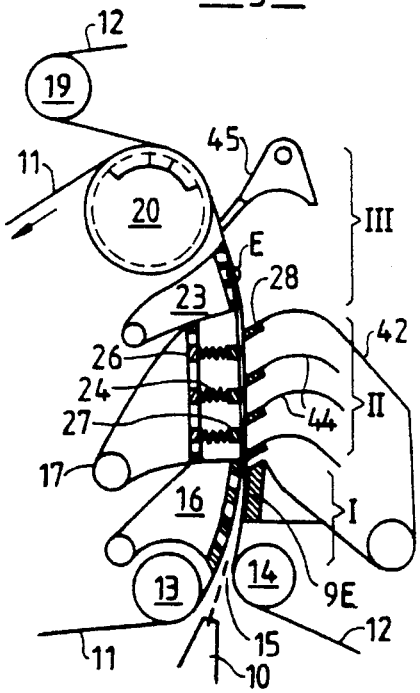

The embodiments shown in FIGS. 4 and 5 differ from the others primarily by the fact that the twin-wire zone rises substantially vertical from the bottom to the top. In this way, the discharge of the water removed from the fiber suspension is simplified, since the water can be discharged substantially uniformly towards both sides. In particular, no vacuum chambers are required in the middle section II of the twin-wire zone. The forming shoes 16, 23, particularly those arranged in the third section III, can, if necessary, be provided with a suction device.

Further elements of the twin-wire former shown in FIG. 4 are a forming suction roll 40 as well as various water-collection containers 41, 42 and 43 and furthermore guide plates 44 which are associated with the stationary ledges 28, as well as a water-discharge ledge 45. The other elements are provided with the same reference numerals as the corresponding elements in FIG. 3. The same applies to FIG. 5. With regard to further details of the embodiments according to FIGS. 3 to 5, reference is had to Patent Application PCT/EP 90/01313 which is equivalent to ± WO 91/02842.

In FIG. 4— similar to FIG. 2— a shoe 9D having a substantially water-impermeable surface is provided at the feed end of the water-removal box 17, and therefore in front of the resilient ledges 27. In FIG. 5, on the other hand, such a shoe 9E is arranged in front of the rigid ledges 28.

Figure 3:
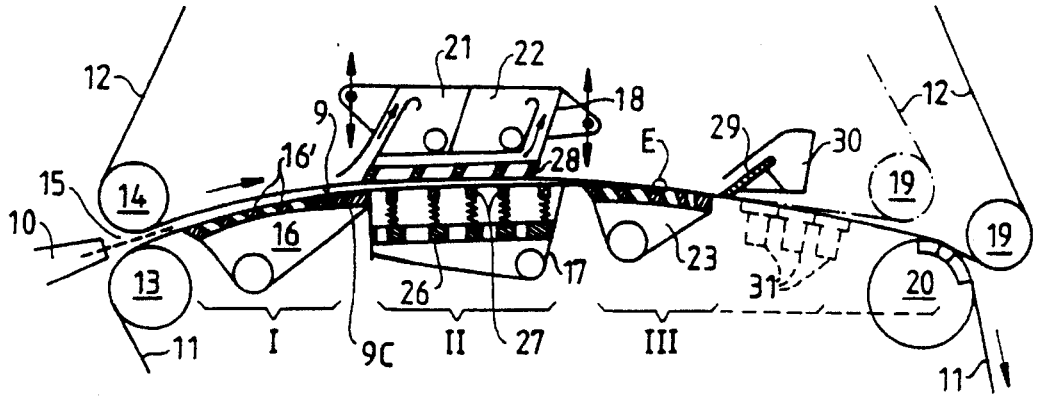

The embodiments in accordance with FIGS. 3 to 5 have the feature in common that each of the shoes 9C, 9D and/or 9E temporarily brakes the removal of water through one of the two wires. This increases (as already explained) the quality of the web. Furthermore, the possibility is obtained of controlling the distribution of the fines and fillers over the thickness of the web (by varying the position and/or the length of the substantially water-impermeable wire support surface 9).

FIG. 6 differs in only a few details from FIG. 1: The lower water-removal box 17 now has two rigid ledges 8 below the wire guide roll 14. A substantially water-impermeable plate 9F is substantially shorter in the direction of the travel of the wire than in FIG. 1; its length L is only about 20% of the length of the sandwich zone S. It lies below the first three upper ledges 28', 28 and therefore exclusively within the sandwich zone, and is supported on the rigid plate 26 by ledges 27B and pneumatic pressure cushions 24B. As an alternative to FIG. 6, the following is possible: Each of the ledges 27B has a widened head over which the bottom wire 11 slides. In such case, the plate 9F would be eliminated.

FIG. 7 shows further possible modifications of the embodiment shown in FIG. 1: The two water-removal boxes 17 and 18 form a sandwich zone S which is slightly inclined downward (with respect to the direction of travel of the wire). The wire guide roll 14' is developed as forming roll (i.e. with water-storage properties in the roll jacket) and is arranged at a shorter distance from the first upper ledge 28', so that the water which is slung off by the roll 14' passes into the front vacuum chamber 21. The substantially water-impermeable plate 9G which is resiliently supported on the rigid plate 26 rests at its feed end in a pivot joint 2 and at its discharge end on two pneumatic pressure cushions 24B (or on one of them). The initial region of the plate 9G is curved in order to deflect the bottom wire 11 which arrives in horizontal direction into the inclined sandwich zone S. Somewhat before the curved region a secondary headbox 10' is arranged, so that the jet of pulp 1' emerging from it impinges in the curved region on the (in part still liquid)

fiber suspension 1 arriving with the bottom wire 11. The upper water-removal box has an extension in the form of a curved suction box 23' which again deflects the two wire belts 11, 12 upward and effects a forced removal of water from the web formed. The features of FIG. 7 described above can be used individually or in combination with each other in the twin-wire former of FIG. 1. The wire guide roll 14' which is developed as forming roll and brings the top wire 12 into direct contact with the fiber suspension can assure an early commencement of the removal of water through the upper wire and possibly a certain flattening of the jet coming from the secondary headbox 10', if said jet is to be somewhat undulated over the width of the wire.

FIG. 8 shows possible modifications of FIG. 2. Instead of the water-impermeable shoe 9B (FIG. 2), a perforated plate 9H is provided as part of a suction box 17' which is supported rigidly (or resiliently) on the rigid plate 26. The plate 9H forms a wire support surface 9" which is of only limited water permeability so that, in its region, the removal of water in downward direction is braked but not completely prevented. In general, the following applies: The wire support surface 9" can be provided with continuous holes or slits. It is also conceivable for the plate 9H to have grooves or furrows on its surface. The slits, grooves or furrows can extend parallel to the direction of travel of the web or form an acute angle with it, which angle is preferably less than 45°.

Upon the manufacture of the said plate 9H, one can now so select the percentage of the open surface, referred to the entire surface of the wire support surface 9", in such a manner that the water permeability of the wire support surface assumes as precisely as possible the value which results in the desired improvement in the quality of the finished fiber web. As a rule, the open surface will be made relatively small so that the water permeability of the wire support surface 9" is substantially less than the water permeability of the lower wire 11. A vacuum which is variable during operation can be maintained in the suction box 17'. In this way it is possible to control, within wide limits, the speed of the removal of water which takes place through the bottom wire 11 in the region of the wire support surface 9" during operation. If the speed of water removal is to be kept relatively low in the region of the wire support surface 9", the vacuum will be set to a very small value, possibly to a value of zero. As an alternative to this, one can, if necessary, establish a certain pressure within said box. In such case, the wire support surface 9" acts precisely as though it were water-impermeable.

For this purpose, a conduit 30, which can be connected by a switch 31 (indicated only symbolically) either to a suction blower 32 or to a source of compressed air 33, debouches into the suction box 17'. Thus, a vacuum or pressure can be established as desired in the suction box 17', its value being variable by means of a control valve 34.

Figure 9:
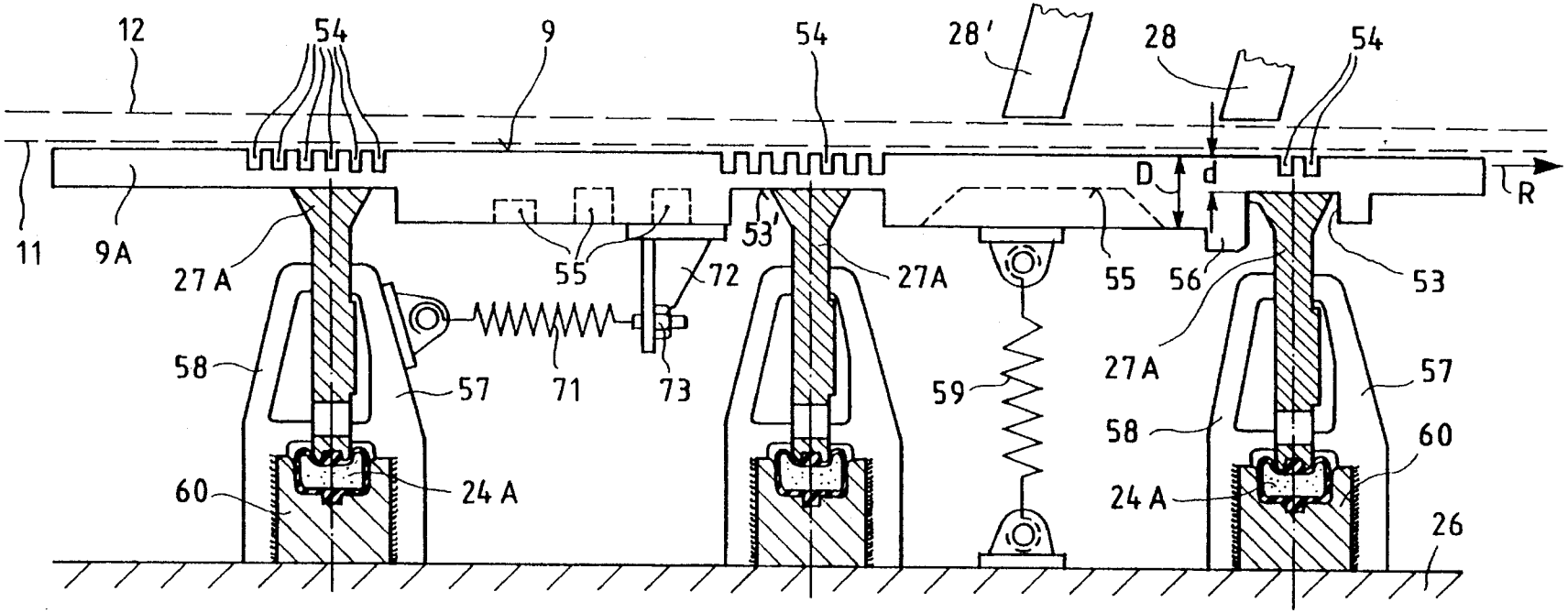
FIGS. 9, 10 and 11 show structural details in different embodiments.

FIG. 9 shows details of the plate 9A which was only indicated in FIG. 1 and of the corresponding pressing device. Two wire belts 11 and 12, namely a bottom wire 11 and a top wire 12, travel in the direction indicated by the arrow R. Only the first two ledges 28' and 28 of an upper water removal box are indicated, they extending transverse to the direction of travel of the wire. The plate 9A is supported on a stationary water-permeable plate 26 by ledges 27A via pneumatic pressure cushions 24A, U-shaped ledges 60 being fastened on said plate. These shaped ledges 60, the pressure cushions 24A which lie therein and the ledges 27A, as well as the plate 9A, extend transverse to the direction of travel R of the wire over the entire width of the machine. By varying the pressure in the pressure cushions 24A, the plate 9A can be pressed by the ledges 27A with a selectable force against the bottom of the bottom wire 11. If necessary, the plate 9A can also be lowered downward from the bottom wire 11. For the vertical guidance of the ledges 27A there are provided, in accordance with DE 40 19 884 (=U.S. Pat No. 5,078,835), individual guide arms 57, 58, arranged in pairs which are distributed at relatively large distances apart over the length of the ledges 27A.

One of the ledges 27A (which are also referred to as "pressing ledges") extends with its head into a transverse groove 53 which is provided on the bottom of the plate 9A and at the same time forms a bending joint. The feed-side edge of the transverse groove 53 forms a stop 56. It comes against the head of the ledge 27 and thus prevents further displacement of the plate 9A in the direction of travel R of the wire. Such a displacement could be caused by the frictional force of the bottom wire 11 on the plate 9A. In the embodiment shown, three ledges 27A are provided for the supporting of the plate 9A. Differing from this, only two ledges or more than three ledges, could be provided. On the middle ledge 27A there is also provided a transverse groove 53' which forms a bending joint. In other words, at the place where the heads of the ledges 27A rest against the plate 9A, the normal thickness D of the plate is reduced to the value d, for instance to approximately one half of the normal plate thickness D. The plate 9A in this way has a bending joint at each place where the head rests against a ledge 27A. It is thus made possible that the wire support surface 9 is not exactly flat in all conditions of operation. Accordingly, the travel path of the bottom wire 11 also need not be precisely flat in all conditions of operation. In order words, the zones of the plate which lie one behind the other (with respect to the direction of travel of the wire) can be pressed with different forces against the bottom wire. The bendability of the plate 9A can be increased at the places where the ledges 27A rest against it by narrow grooves 54; these grooves 54 are worked into the plate from the side of the wire support surface 9. Additional transverse grooves 55 or 56 (of any cross-sectional shape) can be worked from below into the plate 9A in order further to reduce its flexural stiffness in the direction of travel R of the wire.

When the two wire belts 11 and 12 travel in approximately horizontal direction, as shown in FIG. 9, the plate 9A then rests under its own weight on the ledges 27A. The plate 9A is preferably made of plastic, so that its weight per square meter of surface is only about 30 kg or less. Therefore, the plate 9A, after it has been lowered, can be removed from the machine transverse to the direction of travel R of the wire (and therefore perpendicular to the plane of the drawing) and be inserted again in the same or a similar position. If the wire belts 11 and 12 do not extend horizontally, but obliquely or vertically (from the bottom to the top or from the top to the bottom), it may be advisable to couple the plate 9A by at least one tension spring 59 to the stationary plate 26. In this way, the plate 9A always remains in reliable contact with the ledges 27A, although no firm attachment is present between these parts.

A supporting of the plate 9A with the least possible friction by means of one of the pressing ledges 27A on the stationary structure 57, 26 can also be achieved in the following manner: A tension spring 71 extends in the direction of travel R of the wire from the stationary structure 57, 26 to a bracket 72 fastened on the bottom of the plate 9A. The tensile force of the spring 71 thus counteracts the frictional force which the bottom wire 11 exerts on the plate 9A. The amount of the tensile force can be adjusted by means of a nut 73, so that it can be adapted relatively precisely to the frictional force. Only one tension spring 71 is visible in FIG. 1; actually, several tension springs 71, arranged distributed over the width of the machine, will be present.

Figure 10:
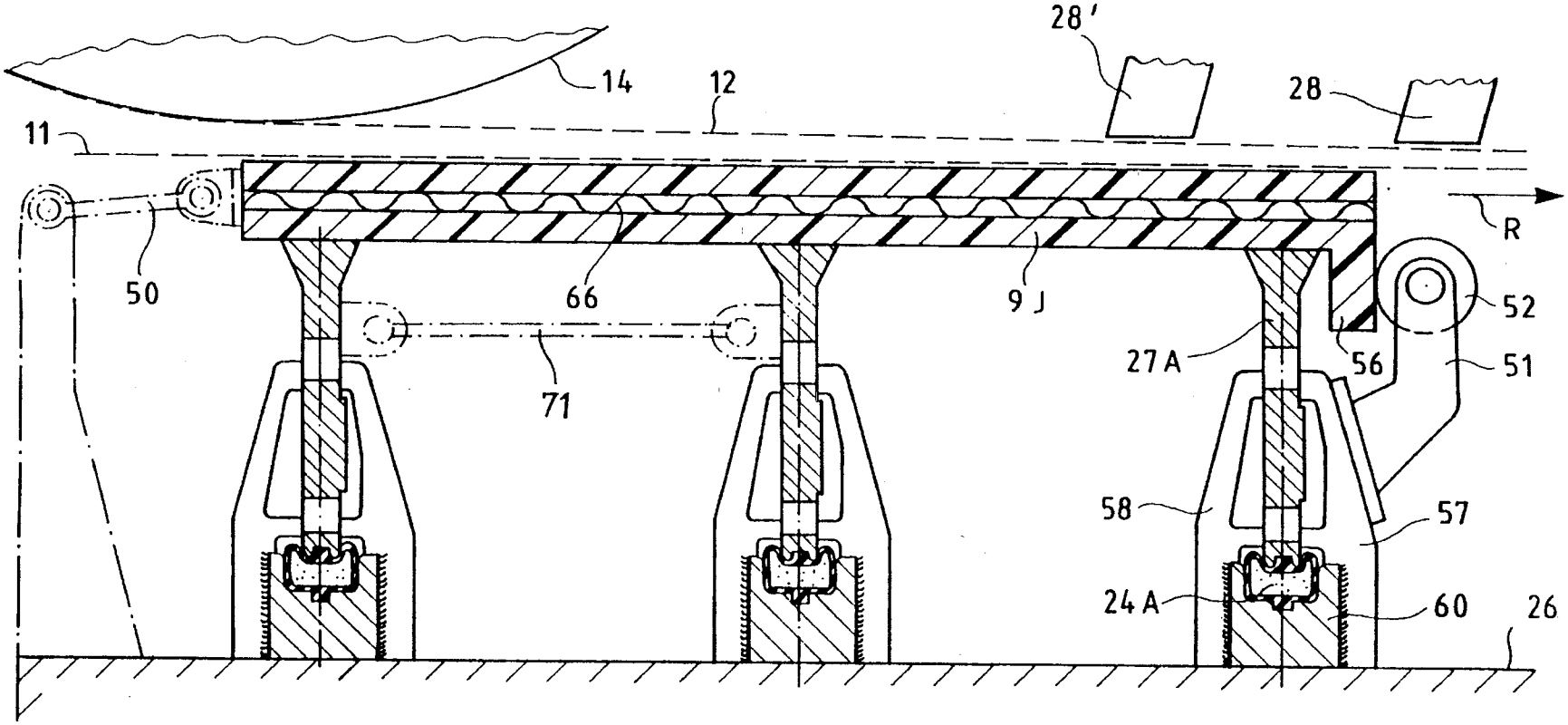

In the embodiment in accordance with FIG. 10, the following is provided in order to secure the plate 9J in the direction of travel R of the wire: From the plate, a projection 56 extends downward and rests against a roller 52. This roller is rotatably mounted on a bracket 51, which is fastened to the stationary structure. In this way, there is obtained a sliding with little friction of the ledges 27A between the guide arms 57, 58 upon the placing of the plate 9J against the bottom wire 11. As an alternative to this, the low-friction supporting of the plate could also be obtained by means of a strap 50 one end of which is pivoted to the plate and its other end to the stationary structure. The plate 9J can be formed of a relatively thick but flexible foil, for instance having several incorporated layers of reinforcement threads, or— as shown— having an incorporated fabric 66.

Figure 11:
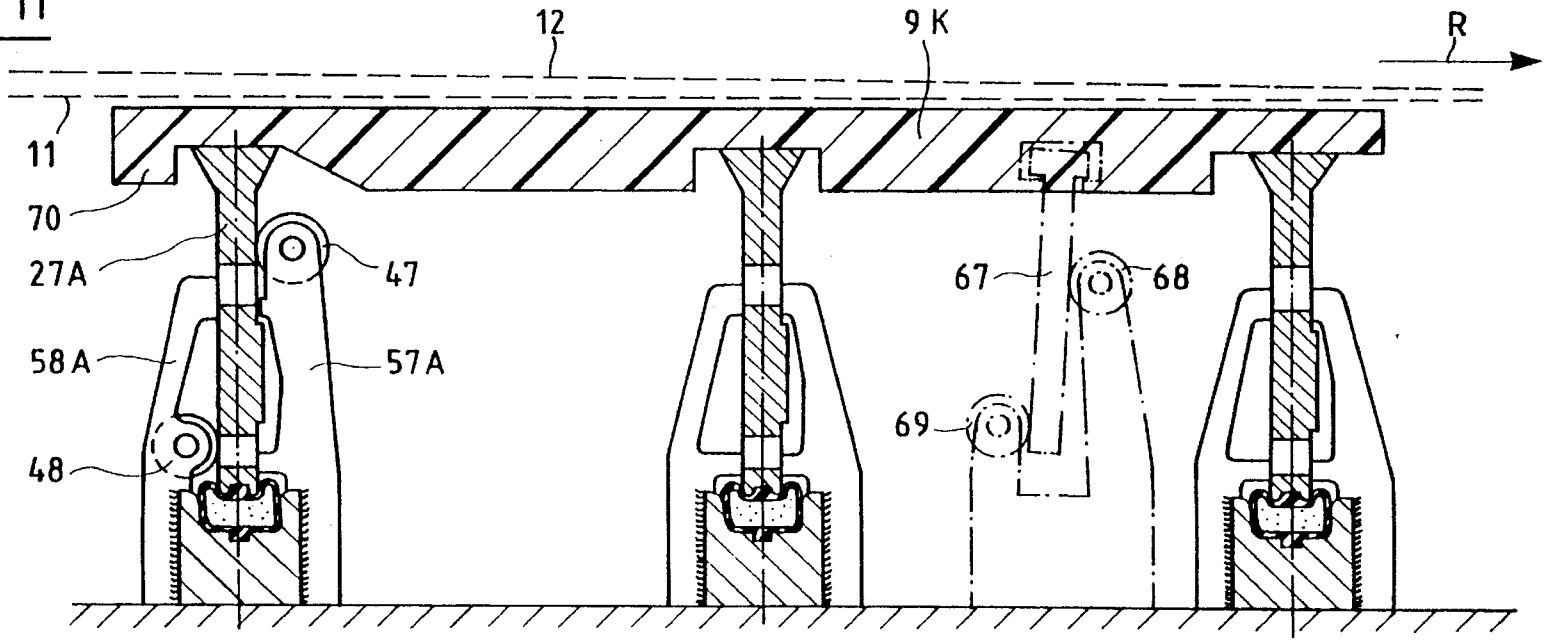

Further alternatives for the low-friction supporting of the plate 9K are shown in FIG. 11: On one of the ledges 27A, rollers 47 and 48 are provided on the guide arms 57A and 58A, respectively. In a variant, shown in dot-dash line, the horizontal supporting of the plate 9K is effected not via the ledges 27A but via at least one additional support member 67. The latter is inserted by means of a T-shaped head into a T-groove of the plate 9K and guided in tiltable manner therein; it is furthermore guided between two rollers 68 and 69 which are mounted on the stationary structure. It is understood that in this case the projection 70 on the plate 9K is dispensed with.

Figure 12:
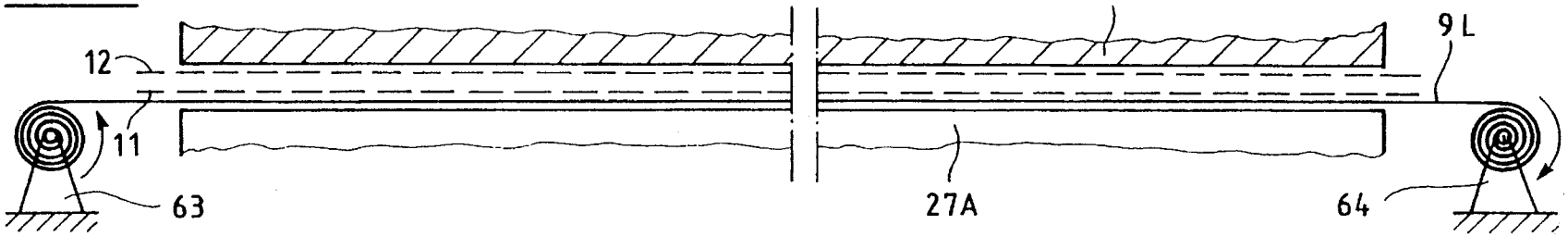
FIG. 12 is a diagrammatic cross section through the initial region of a twin-wire zone having a closed wire support surface in the form of a foil.

In accordance with FIG. 12, the plate 9L is developed as a relatively thin flexible foil. It extends from a first winding device 63 transversely through the machine to a second winding device 64. By means of these winding devices 63, 64, the foil 9L is held under a certain tension; it is furthermore— as in the other embodiments— pressed by means of ledges 27A resiliently against the lower wire belt 11. The direction of travel of the wire in FIG. 12 is perpendicular to the plane of the drawing.

In all figures the resiliently supported ledges 27 and/or 27A are shown as ledges which are independent of each other. Differing from this, two or more adjacent ledges 27 and/or 27A could be coupled to each other, for instance by means of struts or straps which extend approximately parallel to the direction of travel of the wire from ledge to ledge, as shown diagrammatically, for instance, in FIG. 10 at 71.

We claim:

1. A twin-wire former for the production of a fiber web from a fiber suspension, the former comprising:

a first and a second paper machine wire belt moving in a web travel direction and forming a twin-wire zone for fiber suspension to move between the belts;

a primary headbox for delivery of a fiber suspension to the twin wire zone;

within the twin-wire zone, at the outer side of the first wire belt which is the side away from the second wire belt, a first plurality of rigid ledges arranged at a distance apart from each other, and a water removal box supporting the first ledges;

within the twin-wire zone, a second plurality of ledges which lie opposite the first rigid ledges and which are at the outer side of the second wire belt which is the side away from the first wire belt, resilient support means supporting the second ledges to be pressed with selectable force against the second wire belt; and the twin-wire zone having a region of commencement upstream with respect to the travel direction, an essentially water-impermeable wire support surface at the outer side of at least one of the wire belts at the region of commencement of the twin-wire zone, said wire support surface bridging at least two of said respective ledges at the at least one wire belt, and structured to prevent removal of water from the fiber web.

2. The twin-wire former of claim 1, wherein the wire support surface is at the outer side of the second wire belt.

3. The twin-wire former of claim 1, wherein the wire support surface is at the outer side of the first wire belt.

4. The twin-wire former of claim 1, wherein the region in the travel direction where the first and second pluralities of ledges lie opposite each other, together with at least a part of the wire support surface, form a sandwich zone; the length of the wire support surface is in the range of 10% to 60% of the length of the sandwich zone.

5. The twin-wire former of claim 4, wherein the wire support surface lies partly upstream with respect to the travel direction of the sandwich zone and partly within the sandwich zone.

6. The twin-wire former of claim 4, wherein the wire support surface lies completely within the sandwich zone.

7. The twin-wire former of claim 4, wherein the position of the wire support surface is adjustable parallel to the direction of travel of the wire.

8. The twin-wire former of claim 1, wherein the position of the wire support surface is adjustable parallel to the direction of travel of the wire.

9. The twin-wire former of claim 1, further comprising resilient elements for pressing the wire support surface with selectable force against the respective wire belt at the outside of which the wire support surface is located.

10. The twin-wire former of claim 9, wherein the wire support surface has a front edge upstream with respect to the travel direction and a pivot joint in the twin-wire former for supporting the front edge of the wire support surface for pivoting of that surface toward and away from the respective wire belt with respect to the travel direction.

11. The twin-wire former of claim 1, wherein in the twin-wire zone, the wire belts travel in a predominantly horizontal path along the travel direction through the twin-wire zone, whereby the first wire belt is the top wire belt and the second wire belt is the bottom wire belt;

the resiliently supported ledges and the resilient support means are below the bottom wire belt.

12. The twin-wire former of claim 11, wherein upstream of the twin-wire zone with respect to the travel direction, the bottom wire belt travels in the travel direction, and the bottom wire belt has a single-wire water removal path that is upstream with respect to the travel direction from the twin-wire zone; and the top wire belt comes into contact with the suspension on the bottom wire belt downstream in the travel direction from the single wire removal path to define the start of the twin-wire zone.

13. The twin-wire former of claim 12, further comprising a secondary headbox for delivery of fiber suspension located shortly in front of the start of the twin-wire zone in the travel direction; the wire support surface directly following the secondary headbox in the travel direction.

14. The twin-wire former of claim 1, wherein the wire support surface is convexly curved with reference to the respective wire belt passing thereover.

15. The twin-wire former of claim 1, wherein the wire support surface is rigidly supported on the twin-wire former.

16. The twin-wire former of claim 1, wherein the wire support surface is water impermeable.

17. The twin-wire former of claim 1, wherein the wire support surface includes openings sized and placed for causing a braked discharge of water.

18. The twin-wire former of claim 17, further comprising a pressurizable box and the wire support surface being provided on the box, the pressure in the box being variable between positive and negative values.

19. The twin-wire former of claim 9, wherein the resilient support for the wire support surface comprises moveable pressing ledges which extend transversely to the travel direction, resilient elements on which the moveable pressing ledges are supported, and the twin-wire former including a stationary structure on which the resilient elements are guided.

20. The twin-wire former of claim 19, wherein the wire support surface is a plate which rests loosely at the moveable pressing ledges, the plate having at least one stop by which it can be supported on the stationary structure of the twin-wire former with respect to movement of the plate with respect to the travel direction.

21. The twin-wire former of claim 20, wherein the stop on the wire support plate cooperates with one of the ledges for controlling the movement of the plate with respect to the travel direction.

22. The twin-wire former of claim 20, further comprising a roller rotatably mounted on the stationary structure and the stop on the plate being positioned to be supported with respect to movement with respect to the travel direction by the roller.

23. The twin-wire former of claim 22, wherein the stop comprises a member tiltably mounted on the wire support plate.

24. The twin-wire former of claim 20, wherein the wire support plate is supported for being pushable transversely to the travel direction of the wire belt.

25. The twin-wire former of claim 19, further comprising tension springs supporting the wire support surface which is a plate on the stationary structure, and the spring force of the tension springs is selected to act against movement in the travel direction.

26. The twin-wire former of claim 19, further comprising a horizontal bending joint which extends transversely to the travel direction, and the wire support surface is a plate which is flexuarally soft around the horizontal bending joint.

27. The twin-wire former of claim 26, wherein the bending joint is in the region of one of the ledges and the plate has a groove on the side thereof toward the bending joint, the groove extending transversely to the travel direction.

28. The twin-wire former of claim 9, wherein the wire support surface is a plate which comprises a foil having a reinforcement insert.

29. The twin-wire former of claim 9, wherein the wire support surface is a plate which comprises a foil which is stretchable transversely to the travel direction.

30. The twin-wire former of claim 29, wherein the foil is held under tension transversely to the travel direction.

31. The twin-wire former of claim 30, wherein the foil of the wire support plate is windable and unwindable.

32. The twin-wire former of claim 1, further comprising a respective wire support surface at the outside of both the first and second wire belts.

33. The twin-wire former of claim 1, wherein each of the wire belts is a respective endless loop wire belt and the respective pluralities of ledges are within the loops of the wire belts, and the wire support surface is within the loop of the at least one wire belt.

34. The twin-wire former of claim 1, wherein the second wire belt is an endless loop wire belt, and the wire support surface is located within the loop of the second wire belt.

35. A twin-wire former for the production of a fiber web from a fiber suspension, the former comprising:

a first and a second paper machine wire belt moving in a web travel direction and forming a twin-wire zone for fiber suspension to move between the belts;

a primary headbox for delivery of a fiber suspension to the twin wire zone;

within the twin-wire zone, at the outer side of the first wire belt which is the side away from the second wire belt, a first plurality of rigid ledges arranged at a distance apart from each other, and a water removal box supporting the first ledges;

within the twin-wire zone, a second plurality of ledges which lie opposite the first rigid ledges and which are at the outer side of the second wire belt which is the side away from the first wire belt; resilient support means supporting the second ledges to be pressed with selectable force against the second wire belt;

the twin-wire zone having a region of commencement upstream with respect to the travel direction, a wire support surface at the outer side of at least one of the wire belts at the region of commencement of the twin-wire zone;

the region in the travel direction where the first and second pluralities of ledges lie opposite each other, together with at least a part of the wire support surface, form a sandwich zone, the length of the wire support surface is in the range of 10% to 60% of the length of the sandwich zone, the position of the wire support surface is adjustable parallel to the direction of travel of the wire;

the wire support surface includes a forming shoe having a slide surface thereon, the wire support surface is convexly curved with reference to the respective wire belt passing thereover and is rigidly supported on the twin-wire former, and the wire support surface is water impermeable.

36. A twin-wire former for the production of a fiber web from a fiber suspension, the former comprising:

a first and second paper machine wire belt moving in a web travel direction and forming a twin-wire zone for fiber suspension to move between the belts;

a primary headbox for delivery of a fiber suspension to the twin wire zone;

within the twin-wire zone, at the outer side of the first wire belt which is the side away from the second wire belt, a first plurality of rigid ledges arranged at a distance apart from each other, and a water removal box supporting the first ledges;

within the twin-wire zone, a second plurality of ledges which lie opposite the first rigid ledges and which are at the outer side of the second wire belt which is the side away from the first wire belt, resilient support means supporting the second ledges to be pressed with selectable force against the second wire belt;

the twin-wire zone having a region of commencement upstream with respect to the travel direction, an essentially water-impermeable wire support surface at the outer side of at least one of the wire belts at the region of commencement of the twin-wire zone;

resilient elements for pressing the wire support surface with selectable force against the respective wire belt at the outside of which the wire support surface is located, the resilient support for the wire support surface having moveable pressing ledges which extend transversely to the travel direction and resilient elements on which the moveable pressing ledges are supported, the twin-wire former including a stationary structure on which the resilient elements are guided;

the wire support surface is a plate which rests loosely at the moveable pressing ledges, the plate having at least one stop by which it can be supported on the stationary structure of the twin-wire former with respect to movement of the plate with respect to the travel direction; and a roller rotatably mounted on the stationary structure and the stop on the plate being positioned to be supported with respect to movement with respect to the travel direction by the roller.

37. A twin-wire former for the production of a fiber web from a fiber suspension, the former comprising:

a first and a second paper machine wire belt moving in a web travel direction and forming a twin-wire zone for fiber suspension to move between the belts;

a primary headbox for delivery of a fiber suspension to the twin wire zone;

within the twin-wire zone, at the outer side of the first wire belt which is the side away from the second wire belt, a first plurality of rigid ledges arranged at a distance apart from each other, and a water removal box supporting the first ledges;

within the twin-wire zone, a second plurality of ledges which lie opposite the first rigid ledges and which are at the outer side of the second wire belt which is the side away from the first wire belt; resilient support means supporting the second ledges to be pressed with selectable force against the second wire belt;

the twin-wire zone having a region of commencement upstream with respect to the travel direction, an essentially water-impermeable wire support surface at the outer side of at least one of the wire belts at the region of commencement of the twin-wire zone;

resilient elements for pressing the wire support surface with selectable force against the respective wire belt at the outside of which the wire support surface is located, the resilient support for the wire support surface having moveable pressing ledges which extend transversely to the travel direction and resilient elements on which the moveable pressing ledges are supported, the twin-wire former including a stationary structure on which the resilient elements are guided;

the wire support surface is a plate which rests loosely at the moveable pressing ledges, the plate having at least one stop by which it can be supported on the stationary structure of the twin-wire former with respect to movement of the plate with respect to the travel direction;

a roller rotatably mounted on the stationary structure and the stop on the plate being positioned to be supported with respect to movement with respect to the travel direction by the roller; and the stop having a member tiltably mounted on the wire support plate.

38. A twin-wire former for the production of a fiber web from a fiber suspension, the former comprising:

a first and a second paper machine wire belt moving in a web travel direction and forming a twin-wire zone for fiber suspension to move between the belts;

a primary headbox for delivery of a fiber suspension to the twin wire zone;

within the twin-wire zone, at the outer side of the first wire belt which is the side away from the second wire belt, a first plurality of rigid ledges arranged at a distance apart from each other, and a water removal box supporting the first ledges;

within the twin-wire zone, a second plurality of ledges which lie opposite the first rigid ledges and which are at the outer side of the second wire belt which is the side away from the first wire belt, resilient support means supporting the second ledges to be pressed with selectable force against the second wire belt;

the twin-wire zone having a region of commencement upstream with respect to the travel direction, an essentially water-impermeable wire support surface at the outer side of at least one of the wire belts at the region of commencement of the twin-wire zone;

resilient elements for pressing the wire support surface with selectable force against the respective wire belt at the outside of which the wire support surface is located, resilient support for the wire support surface having moveable pressing ledges which extend transversely to the travel direction and resilient elements on which the moveable pressing ledges are supported, the twin-wire former including a stationary structure on which the resilient elements are guided; and tension springs supporting the wire support surface which is a plate on the stationary structure, and the spring force of the tension springs is selected to act against movement in the travel direction.

39. A twin-wire former for the production of a fiber web from a fiber suspension, the former comprising:

a first and a second paper machine wire belt moving in a web travel direction and forming a twin-wire zone for fiber suspension to move between the belts;

a primary headbox for delivery of a fiber suspension to the twin wire zone;

within the twin-wire zone, at the outer side of the first wire belt which is the side away from the second wire belt, a first plurality of rigid ledges arranged at a distance apart from each other, and a water removal box supporting the first ledges;

within the twin-wire zone, a second plurality of ledges which lie opposite the first rigid ledges and which are at the outer side of the second wire belt which is the side away from the first wire belt, resilient support means supporting the second ledges to be pressed with selectable force against the second wire belt;

the twin-wire zone having a region of commencement upstream with respect to the travel direction, an essentially water-impermeable wire support surface at the outer side of at least one of the wire belts at the region of commencement of the twin-wire zone;

resilient elements for pressing the wire support surface with selectable force against the respective wire belt at the outside of which the wire support surface is located, the resilient support for the wire support surface having moveable pressing ledges which extend transversely to the travel direction and resilient elements on which the moveable pressing ledges are supported, the twin-wire former including a stationary structure on which the resilient elements are guided; and a horizontal bending joint which extends transversely to the travel direction, and the wire support surface is a plate which is flexurally soft around the horizontal bending joint.

40. A twin-wire former for the production of a fiber web from a fiber suspension, the former comprising:

a first and a second paper machine wire belt moving in a web travel direction and forming a twin-wire zone for fiber suspension to move between the belts;

a primary headbox for delivery of a fiber suspension to the twin wire zone;

within the twin-wire zone, at the outer side of the first wire belt which is the side away from the second wire belt, a first plurality of rigid ledges arranged at a distance apart from each other, and a water removal box supporting the first ledges;

within the twin-wire zone, a second plurality of ledges which lie opposite the first rigid ledges and which are at the outer side of the second wire belt which is the side away from the first wire belt, resilient support means supporting the second ledges to be pressed with selectable force against the second wire belt;

the twin-wire zone having a region of commencement upstream with respect to the travel direction, an essentially water-impermeable wire support surface at the outer side of at least one of the wire belts at the region of commencement of the twin-wire zone;

resilient elements for pressing the wire support surface with selectable force against the respective wire belt at the outside of which the wire support surface is located, the resilient support for the wire support surface having moveable pressing ledges which extend transversely to the travel direction and resilient elements on which the moveable pressing ledges are supported, the twin-wire former including a stationary structure on which the resilient elements are guided; and a horizontal bending joint which extends transversely to the travel direction, and the wire support surface is a plate which is flexurally soft around the horizontal bending joint;

the bending joint is in the region of one of the ledges and the plate has a groove on the side thereof toward the bending joint, the groove extending transversely to the travel direction.

41. A twin-wire former for the production of a fiber web from a fiber suspension, the former comprising:

a first and a second paper machine wire belt moving in a web travel direction and forming a twin-wire zone for fiber suspension to move between the belts;

a primary headbox for delivery of a fiber suspension to the twin wire zone;

within the twin-wire zone, at the outer side of the first wire belt which is the side away from the second wire belt, a first plurality of rigid ledges arranged at a distance apart from each other, and a water removal box supporting the first ledges;

within the twin-wire zone, a second plurality of ledges which lie opposite the first rigid ledges and which are at the outer side of the second wire belt which is the side away from the first wire belt; resilient support means supporting the second ledges to be pressed with selectable force against the second wire belt;

the twin-wire zone having a region of commencement upstream with respect to the travel direction; an essentially water-impermeable wire support surface at the outer side of at least one of the wire belts at the region of commencement of the twin-wire zone;

resilient elements for pressing the wire support surface with selectable force against the respective wire belt at the outside of which the wire support is located; and the wire support surface is a plate which includes a foil which is stretchable transversely to the travel direction, the foil is held under tension transversely to the travel direction, and is windable and unwindable.

* * * * *